US007891632B2

(12) United States Patent
Rucinski et al.

(10) Patent No.: US 7,891,632 B2
(45) Date of Patent: Feb. 22, 2011

(54) BOOK HOLDER STAND

(76) Inventors: Phil Rucinski, 8380 E. Thirteen Mile Rd., Warren, MI (US) 48093; Donald Pagels, 8263 Kennedy Cir., Warren, MI (US) 48093

( * ) Notice: Subject to any disclaimer, the term of this patent is extended or adjusted under 35 U.S.C. 154(b) by 0 days.

(21) Appl. No.: 11/879,003

(22) Filed: Jul. 16, 2007

(65) Prior Publication Data

US 2008/0048088 A1 Feb. 28, 2008

Related U.S. Application Data

(60) Provisional application No. 60/831,346, filed on Jul. 14, 2006.

(51) Int. Cl.
*A47B 97/04* (2006.01)

(52) U.S. Cl. ..... 248/447; 248/453; 248/461

(58) Field of Classification Search ..... 248/447.2, 248/441.1, 447, 451–453, 460–462
See application file for complete search history.

(56) References Cited

U.S. PATENT DOCUMENTS

| | | | | |
|---|---|---|---|---|
| 2,156,489 | A * | 5/1939 | Dante | 248/461 |
| 2,256,513 | A | 9/1941 | Bauer | |
| 2,538,318 | A * | 1/1951 | Mitchell | 248/448 |
| 3,339,874 | A * | 9/1967 | Leif | 248/463 |
| 4,518,275 | A * | 5/1985 | Rauch et al. | 402/80 P |
| 4,588,074 | A | 5/1986 | Strong et al. | |
| 4,650,111 | A | 3/1987 | Jahoda | |
| 4,852,909 | A | 8/1989 | Stoyanoff | |
| 5,580,024 | A | 12/1996 | Briee | |
| 5,797,578 | A * | 8/1998 | Graffeo et al. | 248/453 |
| D417,889 | S | 12/1999 | French | |
| 6,109,658 | A | 8/2000 | Moore | |
| 6,283,432 | B1 | 9/2001 | Hoose, Jr. | |
| 6,439,612 | B1 | 8/2002 | Greer | |

* cited by examiner

*Primary Examiner*—Gwendolyn Baxter
(74) *Attorney, Agent, or Firm*—John R. Benefiel

(57) ABSTRACT

A book holder stand has two shallow box like parts hinged together along one side to be openable to extend the parts from each other in opposite directions and define a generally planar support. A pivoted shelf is mounted at the bottom of each part able to be flipped down to provide a support for an opened book placed on edge thereon. An elongated retainer element is pivoted to each shelf by having a first segment received in a hole in an outer face of the associated shelf, with an angled down segment extending from the end of the first segment and able to be swept over an opened book with the shelf flipped down. A locking rod is slidable across the hinged sides to lock the parts in their spaced apart position. A prop rod is pivotally mounted to the hinged side of one part which can be pivoted out to extend at an angle thereto to support the book holder stand at an inclined position for convenient reading of an opened book resting on the shelves.

7 Claims, 5 Drawing Sheets

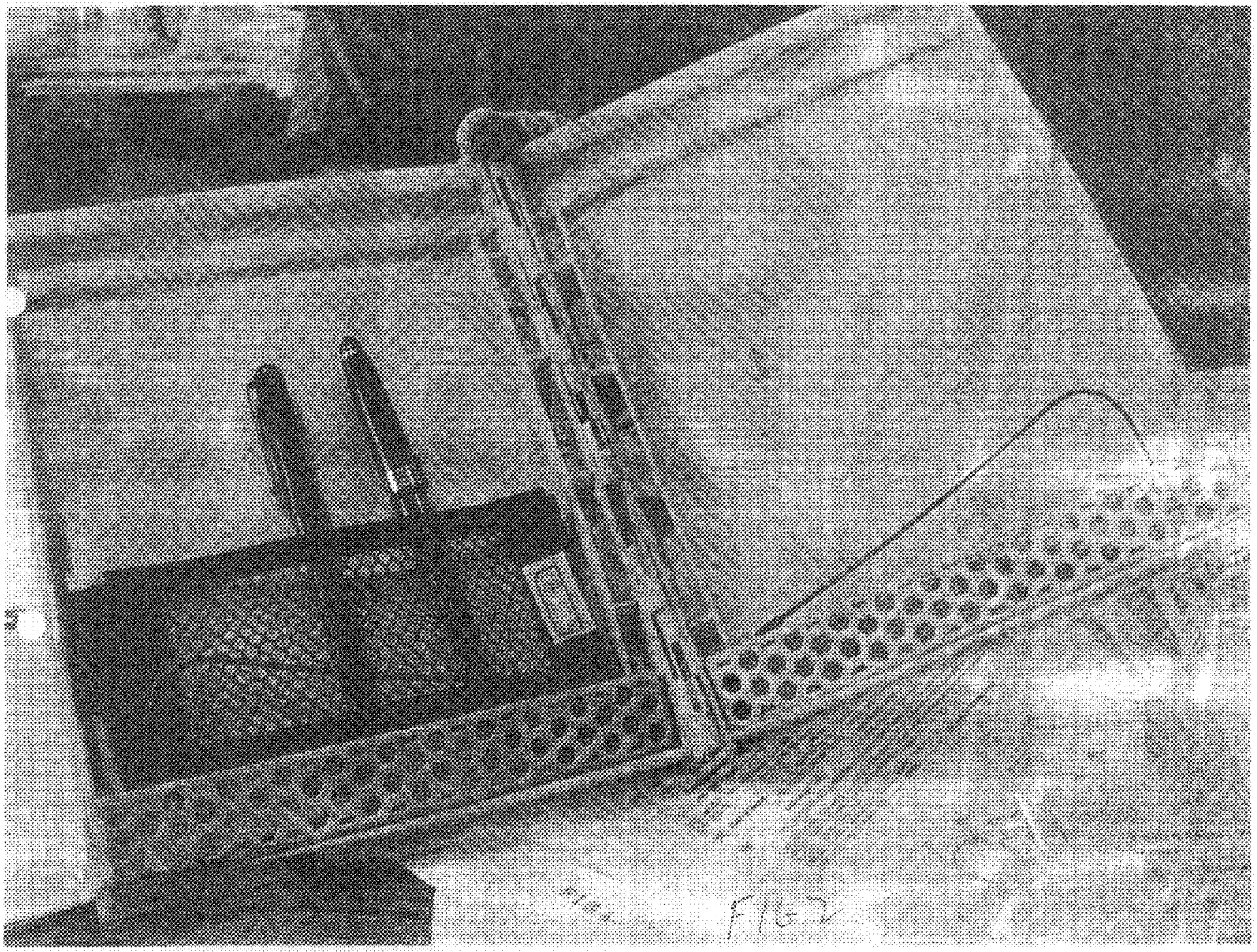

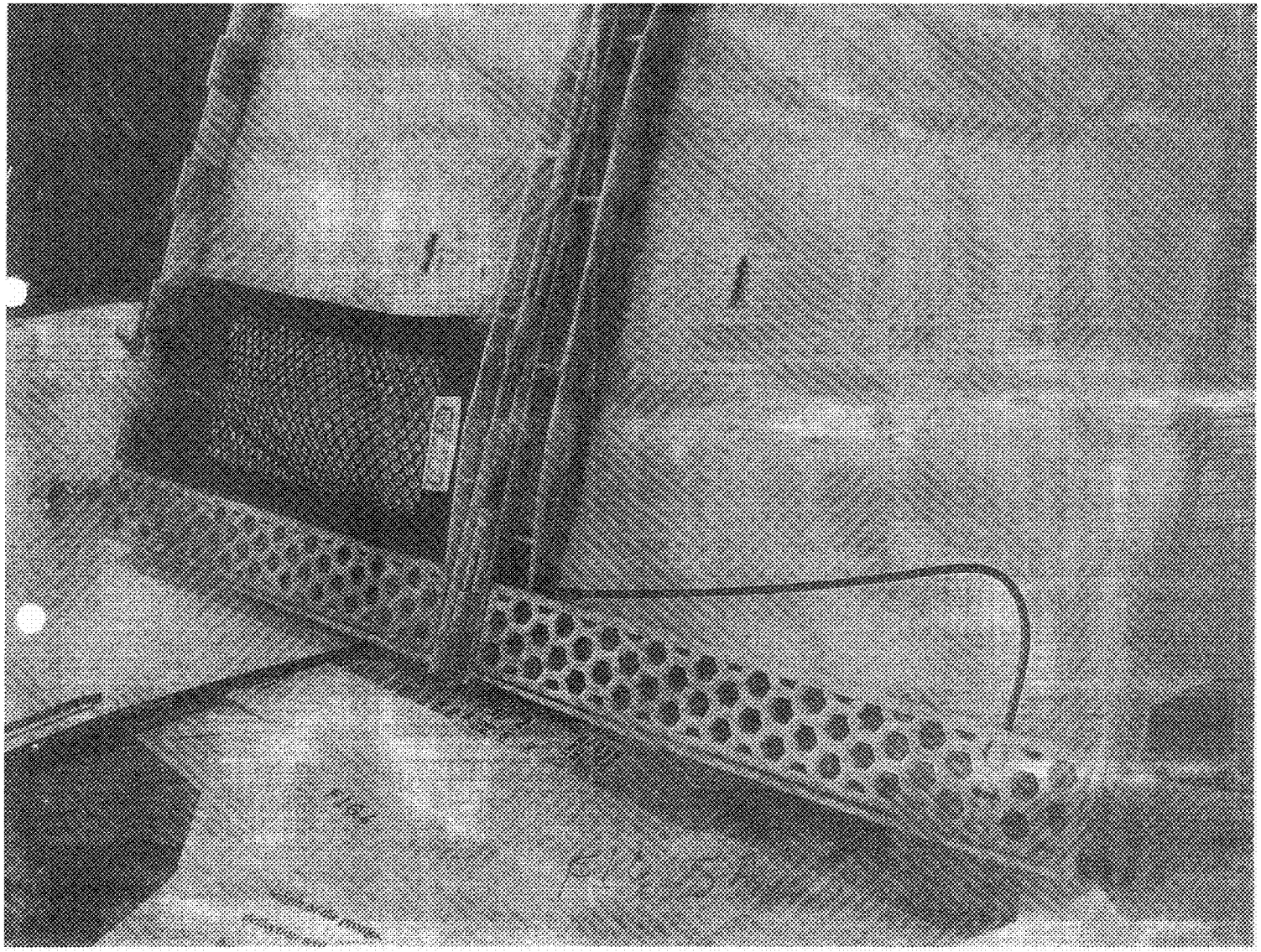

BOOK HOLDER STAND

CROSS REFERENCE TO RELATED APPLICATIONS

This application claims the benefit of U.S. provisional application Ser. No. 60/831,346 filed on Jul. 14, 2006.

BACKGROUND OF THE INVENTION

This invention concerns book holder stands of the type comprising a structure which allow a book to be supported in an opened position for ease in reading.

While such book holder stands have heretofore been devised such as shown in U.S. Pat. No. 4,852,909, in use, such stands lack desirable convenience features are costly to manufacture or complicated to set up.

It is the object of the present invention to provide a book holder stand which is very convenient in use while being simple and durable and inexpensive to manufacture.

SUMMARY OF THE INVENTION

The above objects as well as other objects which will be understood upon a reading of the specification and claims are achieved by a two part case, each part having a shallow box configuration, which parts are hinged together along one side. The two parts when hinged together form an enclosure within which items such as pens and pencils may be stored. The two parts can be hinged apart to assume a laid flat condition extending away from each other to define a generally planar support. A pair of flip down shelves are provided, each located extending across the bottom of the inside of an associate part, which shelves together will support an opened book on edge leaning against the oppositely extending parts.

Each part may be comprised of an identical molded plastic construction with hinge features interleaved together and with common features for other elements of the stand.

A locking rod is slidable within an aligned tubular receptacle on each part to lock the parts in their opened position to be readied for use as a reading stand.

A series of project tabs project from the far side wall of each part and engage the inside of the opposite side wall of the opposing part when the case is closed to hold the parts together.

A prop rod is pivoted at one end to one of the hinged together side walls of one of the parts and extending alone the hinged side thereof, the prop rod pivotally mounted to be able to be swung out from the one part and secured in a position extending at an angle therefrom to allow the opened book holder parts to be leaned back at a convenient inclination for reading a book opened on the two parts. An angled slot in a lip portion on the part perimeter receives and secures the prop rod in its swing out position.

Each book holder stand shelf has a book retainer element, comprised of an elongated thin rod having a first segment in a hole extending in the outer face of an associated shelf. The book retainer elements have an angled segment extending back at an angle from the first segment engagable with an opened book of the stand to hold the book in an opened condition on the stand.

Pencils, pens, etc. may be stored in a net panel forming a pocket mounted extending across the bottom panel inside one or both parts.

DESCRIPTION OF THE DRAWINGS

FIG. 2 is an inside view of the book holder shown in FIG. 1 in the fully opened position.

DETAILED DESCRIPTION

Figure 1:
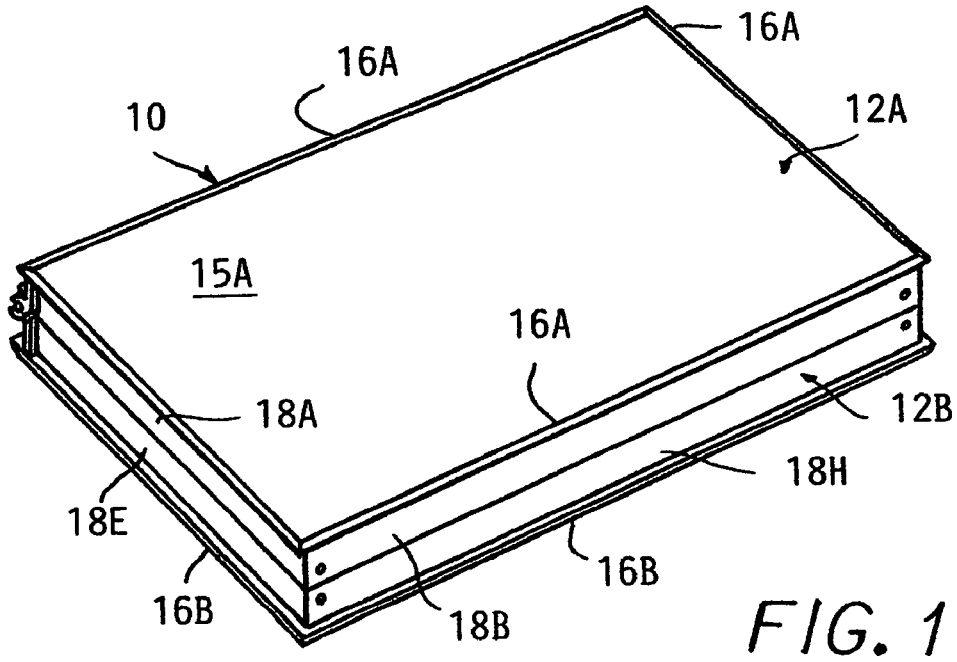
FIG. 1 is a pictorial view of a book holder stand according to the invention in the closed position.
Figure 4:
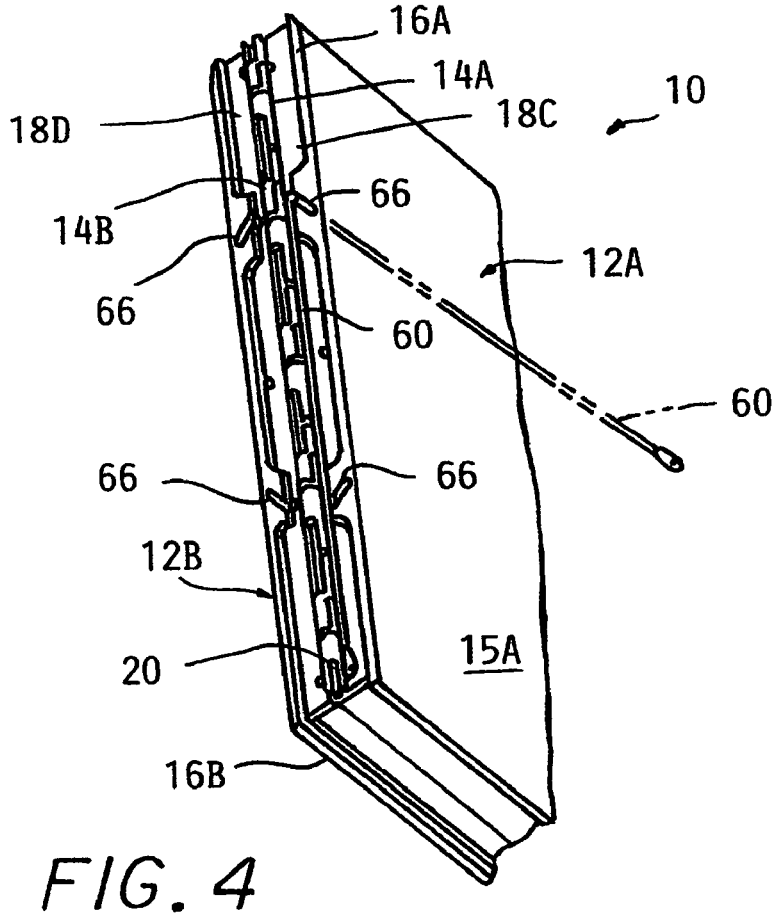
FIG. 4 is a fragmentary end view of the book holder stand shown in FIG. 1 with the prop rod shown in FIG. 1 shown swung out in phantom lines.
Figure 3:
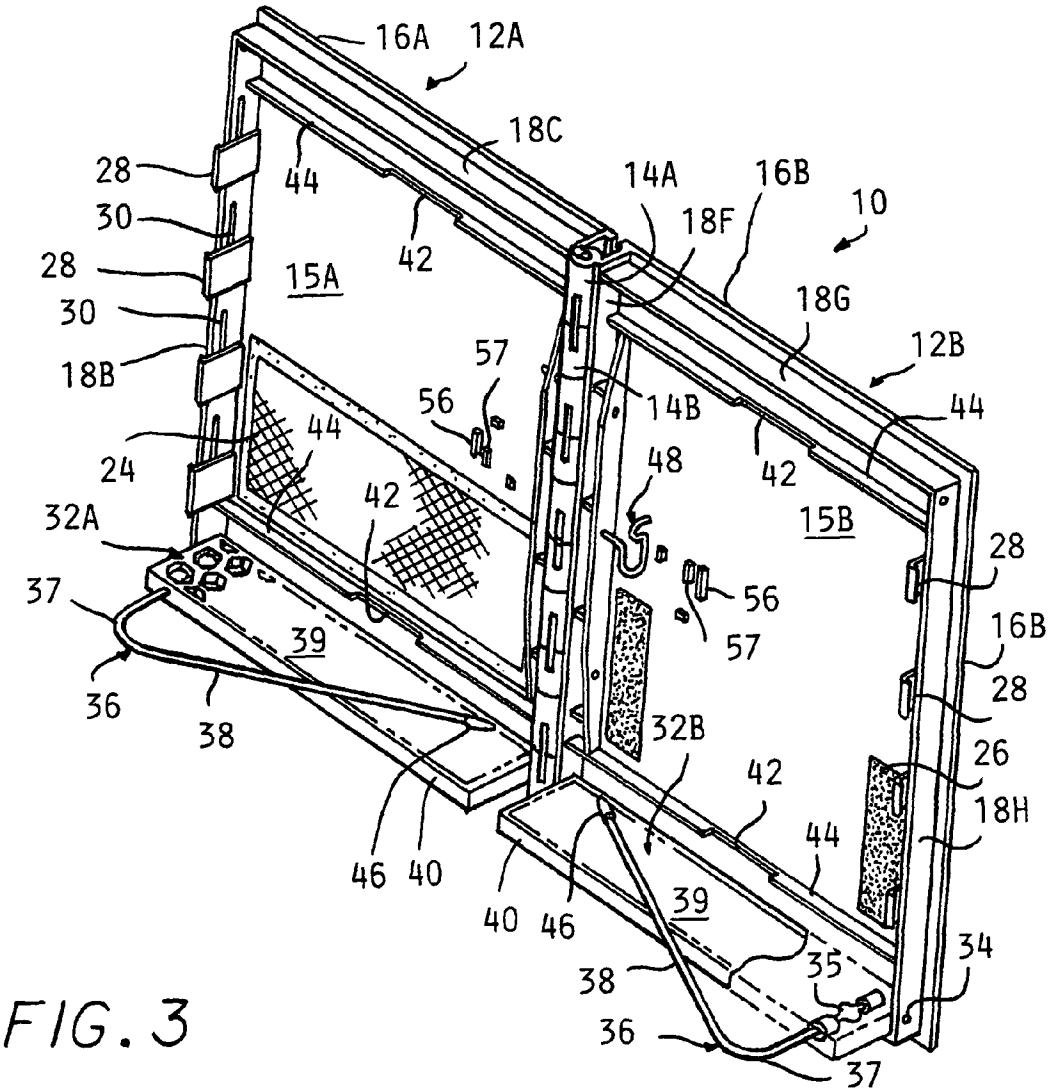
FIG. 3 is a pictorial view of the opened book holder showing the support shelves in their flipped down operative position.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the book holder stand 10 according to the present invention resembles a book in appearance, comprised of two main parts 12A, 12B. Each part 12A, 12, 13 comprises a shallow generally rectangular box shaped piece with a generally planar bottom 15, 15B having a projecting lip 16 extending around the perimeter thereof and overhanging the four side walls 18A, B, C, and D; and E, F, G, and and of each part 12A, 12B H to resemble a book cover and pages when closed together.

The parts 12A, 12B are hinged together along one side wall 18C, 18D by interleaved hinge features 14A, 14B molded into side walls 18C, D. The hinge features 14A, 14B comprise tubular sections which can be partially slotted halfway from each along two or orthogonal directions to simplify the injection mold used to mold the parts in the manner known in the art.

Each part 12A, 12B is of molded plastic and identical to each other. By rotating one part 12A, 12B to invert one part with respect to the other, the hinging features 14A, 14B of the two parts 12A, 12B can be interleaved with one other.

The various mounting holes and other features required are provided at both the top and bottom of each part 12A, 12B to allow mounting of the flip down shelves 32A, 32B and prop rod 60 as described below in either vertical orientation of parts 12A, 12B.

A hinge rod 20 is inserted into openings in the aligned hinge features 14A, 14B to hinge the two parts 12A, 12B together.

A small C-clip can be engaged with a central groove (not shown) in the hinge rod 20 to prevent escape of the hinging rod from the hinge features 14A, 14B.

The open top of each part 12A, 12B faces and abuts each other when the parts 12A, 12B are closed together. A cavity is thereby defined between the parts for storing such items as index cards, pens, pencils, etc. For this purpose mesh panels 24 can be attached as with hook and loop strips 26 to the inside of each part 12A, 12B forming storage pockets.

Projecting snap tabs 28 are molded into the opposite side wall 18B, 18H of each part 12A, 12B from the hinged sides which are interleaved with each other and catch on mating recesses on the inside of the side walls 18B, 18H to releasably hold the parts 12A, 12B closed together.

A pair of flip down shelves 32 is provided, extending across the space between side walls 18B, 18D and 18H, 18F at the bottom region thereof pivoted at either end by integral axle protrusions received in aligned holes 34 in the side walls 18E, 18F.

In a stowed position, the shelves 32A, 32B are flipped up to be parallel to the part bottom panel 15A, 15B positioned against a locator rib 44.

Book page hold down elements 36, comprised of resiliently deflectable thin rods having a first segment 37 extend parallel to the associated shelf 32A or 32B are each received pivotally mounted in a respective socket extending into the outer face 40 adjacent each outer end of the shelves 32A,B. The shelves 32A, 32B are thick enough to accommodate the thickness of the rods 36 as well as being stiff enough to support the weight of a book on edge thereon. The shelves 32A, 32B can be reduced in mass by a pattern of through hex openings 35. The first segment 37 can be secured in its socket by flattening a section thereof through one of the hex openings 35 through which it passes. The hex openings on either side are solid to form the pivot socket.

The hold down elements 36 are each formed with a reverse bend such as to create an angled end segment 38 which extending back over the upper surface 42 of the associated ledge when in the stored position. A notch 42 in each of the locator ribs 44 accommodates a respective thickness of the rod end segment 38 when the shelves 32A, 32B are flipped up against the locator Rib 44.

Figure 5:
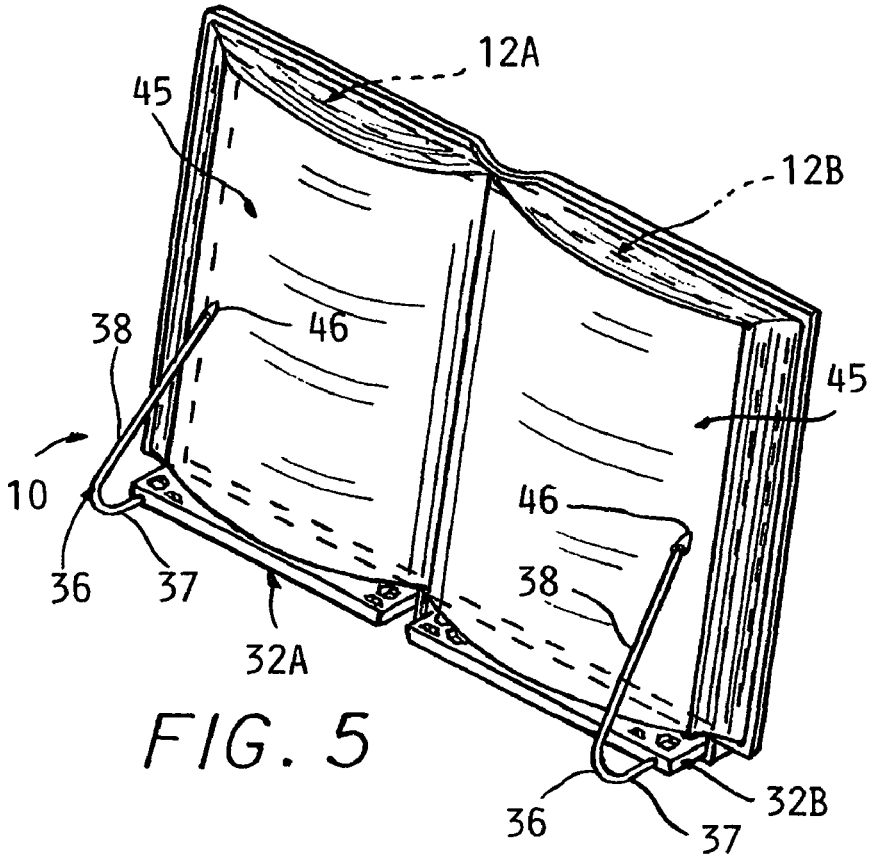
FIG. 5 is a pictorial view of the opened book holder stand with an opened book supported thereon and engaged with the page retainer elements.

The hold down elements 36 are pivoted down to position the angled end segment 38 lying against the top surface 39 of the associated shelf 32A, 32B prior to flipping the shelves 32A, 32B up to be their in stored positions. With the shelves 32A, 23B flipped down, the hold down elements 38 can be pivoted so that the angled end segments 38 can be swept up and over the opened book as seen in FIG. 5 by the first segments 37 rotating in their sockets.

A plastic bead 46 on the tip of each angled end allows contact with the pages without tearing or penetrating the same when being swept across the exposed pages of the book 45 (FIG. 5), by being rotated in the sockets in the shelves 32A, 32B. The tips 46 of the angled ends 38 sweep in the plane of the book pages when the shelves 32A, 32B are flipped down. When flipped up, the angled ends are stowed beneath shelves 32A, 32B.

The book holder stand parts 12A, 12B can be locked in their opened position by a locking rod 48 which is slidably received in a pair of aligned short tubes 50A, 50B integral with a bottom of the respective part 12A, 12B. The tubes 50A, 50B lie between side walls 18C, 18D and a reinforcing ribs 52A, 52B connected with webs 54 to a respective wall 18C, 18D.

When extended, the locking rod 48 spans the joint between the hinged sides of the parts 12A, 12B, effectively preventing any hinging action thereby locking the parts 12A, 12B in their oppositely extending flattened position, providing a stable support for an opened book 45 resting on edge on the shelves 32A, 32B. Projections 56/57 molded in the bottom panel is a secure locking rod 48 in its retracted position.

Figure 6:
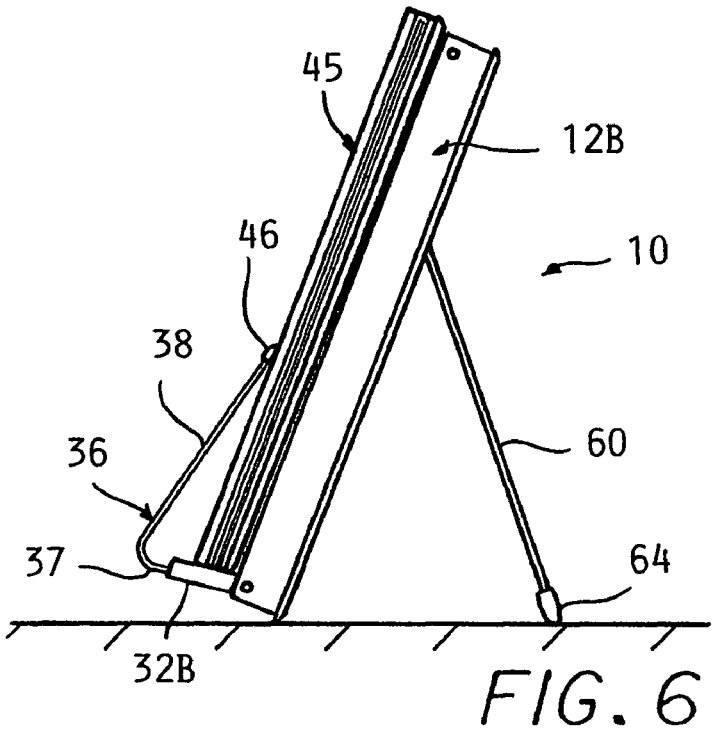
FIG. 6 is a side view of the opened book holder stand with an opened book as shown, with the support rod in its swung out position to allow the book holder stand to be supported in an inclined position.

The book holder stand 10 is also provided with a prop rod 60 which is stowed extending along the hinged side wall 18C of one of the parts 12A. A right angled end 62 is received in holes in the side wall 18C and stiffener rib 52A to create a pivotal mounting allowing the prop rod 60 to swing out of the plane of the part 12A to extend at an angle thereto to allow it to function as a prop or brace for supporting the holder in a leaned back inclined position (FIG. 6). A plastic covered tip 64 avoids any marring of a table surface.

The lip 16A is formed with angled grooves 66 to detent the prop rod 62 in its angled out position. The grooves 66 are provided at upper and lower locations to allow rod mounting in either orientation of either part 12A, 12B. The end 62 is held by a fixed metal washer 65 compressing an elastomeric ring 63. This allows the end to move axially slightly when passing into the groove 66 while preventing any looseness of the prop rod 60.

Accordingly, a compact, convenient to use book holder stand is provided which can be manufactured at low cost.

The invention claimed is:

1. A book holder stand comprising:

a pair of parts each part comprised of a shallow generally rectangular open topped box having a bottom panel and four side walls, said parts hinged together along one side wall of each part by interfitting hinge features to be positioned with edges of the side walls abutting each other in a closed condition of said parts, and said parts extending directly away from each other in a spread apart flattened position of said parts with said hinged side walls positioned alongside each other;

a flip down shelf of a length substantially the same as the width of an associated part and extending within side walls of each part across the bottom panel thereof adjacent a bottom side wall of said associated part, each shelf pivotally mounted to a respective part to selectively be positionable in a stowed position flipped up within said side walls of a respective part and a flipped down position projecting substantially normally to the plane of the bottom panel of an associated part substantially beyond said side walls to enable support thereon of a book resting on edge on an upper surface of each of said shelves; and a pair of page retainer elements, each retainer element associated with a respective shelf and formed of a thin readily resiliently bendable rod, having a first segment pivotally received in a hole in an outer face of said respective shelf downwardly extending from an outer edge of said upper surface with said shelf flipped down, adjacent an outer side of said associated shelf remote from an opposite side of said shelf, and a second segment angled back towards said bottom panel and forming an acute angle with said bottom wall and the pages of an opened book placed on said shelves and of a length extending at least most of the way across the width of an associated shelf when retainer element is pivoted down to extend along said associated shelf, and a tip located on each retainer adjacent an opposite side of said associated shelf when said retainer elements are pivoted down, whereby said tip being able to be swept upwardly and outwardly across a page of an opened book resting on said upper surfaces of said flipped down shelves to be engaged with the outermost margin area of said pages when extending substantially vertically or engagable with said outer face of said associated shelf when not engaging a book and able to be swept outwardly beyond said shelf to be able to engage wider books and to have said tip held against said opened book pages or to engage said outer face of said associated shelf when not engaged with said book pages by bending deflection outward of said second segment to be engaged with said opened book pages or with said outer face of said associated shelf when not engaged with said book pages; and an elongated prop rod having an end segment received in an opening extending into a hinged side wall of one part and a main segment angled from said end segment extending down along the outside of said side wall when in a stowed position and able to be swung out from said side wall of one part to extend in on an inclined position to said one part to allow said book parts when spread out flattened to be supported leaning back by a tip of said prop rod main segment engaging a support surface.

2. The book holder stand according to claim 1 wherein each of said parts include a rib extending across a bottom thereon located to abut against a respective shelf when flipped up into said stowed position, said angled back segment of each retainer element pivoted against a top surface of an associated shelf, and wherein said rib is notched to accommodate said angled back segment with said associated shelf flipped up against said associated rib.

3. A book holder stand comprising a pair of parts each part comprised of a shallow generally rectangular open topped box having a bottom panel and four side walls, said parts hinged together along one side wall of each part by interfitting hinge features to be positioned with edges of the side walls abutting each other in a closed condition of said parts, and said parts extending directly away from each other in a spread apart flattened position of said parts with said hinged side walls positioned alongside each other;

a flip down shelf extending within side walls of each part and across the bottom panel thereof adjacent a bottom side wall, each shelf pivotally mounted to selectively be positionable in a stowed position flipped within said side walls of a respective part and a flipped down position projecting normally to the plane of the bottom panel of an associated part to enable support thereon of a book resting on edge on said shelves; and a locking rod received in an opening in a first elongated element fixed to the inside of one part adjacent said hinged side and slidable into an opening in a second elongated element fixed to the inside of the other part adjacent said hinged side when said opening of said first element is aligned with said opening in said second element when said parts are in said flattened spread apart position, the presence of the locking rod in both said elements maintaining the two openings in alignment preventing said parts from hinging together.

4. The book holder stand according to claim 3 further including a series of tabs projecting from a side wall of each part opposite said hinge side and interleaved with each other and aligned with engagement features on an opposing side wall on the other part to releasably secure said parts together.

5. A book holder stand comprising a pair of parts each part comprised of a shallow generally rectangular open topped box having a bottom panel and four side walls, said parts hinged together along one side wall of each part by interfitting hinge features to be positioned with edges of the side walls abutting each other in a closed condition of said parts, and said parts extending directly away from each other in a spread apart flattened position of said parts with said hinged side walls positioned alongside each other;

a flip down shelf extending within side walls of each part and across the bottom panel thereof adjacent a bottom side wall, each shelf pivotally mounted to a respective sidewall of each part to selectively be positionable in a stowed position flipped within said side walls of a respective part and a flipped down position projecting normally to the plane of the bottom panel of an associated part to enable support thereon of a book resting on edge on said shelves; and an elongated prop rod having an end segment received in an opening extending into a hinged side wall of one part and a main segment angled from said end segment extending down along the outside of said side wall when in a stowed position and able to be swung out from said side wall of one part to extend in on an inclined position to said one part to allow said book parts when spread out flattened to be supported leaning back by a tip of said prop rod main segment engaging a support surface.

6. The book holder stand according to claim 5 wherein a lip projects out from the bottom panel of said one part past said one side wall and an angled groove is formed therein close to said opening in said side wall receiving said prop rod main segment when swung out to said inclined position to act as a detent holding said prop rod in said inclined position.

7. The book holder according to claim 6 wherein said end segment is held in said one side wall by a first metal washer attached to said end segment compressing an adjacent elastomeric ring allowing said angled end segment to move out slightly to allow said main segment to enter said angled groove in said lip.

* * * * *